United States Patent [19]

Gaiser

[11] Patent Number: 4,759,512

[45] Date of Patent: Jul. 26, 1988

[54] MULTIPLE WINDING MACHINE FOR LACE BANDS AND THE LIKE

[75] Inventor: Gerhard O. Gaiser, Norwalk, Conn.

[73] Assignee: American Fabrics Company, Bridgeport, Conn.

[21] Appl. No.: 854,593

[22] Filed: Apr. 22, 1986

[51] Int. Cl.[4] ..... B65H 18/16; B65H 23/00; C08G 73/10

[52] U.S. Cl. ..... 242/67.1 R; 242/67.3 R; 242/65; 242/56.9; 242/76; 242/DIG. 2; 28/170

[58] Field of Search ..... 242/55, 67.1 R, 67.2, 242/67.3 R, 35.5, 56.4, 56.5, 56.9, 65, 158 R, 76, DIG. 2; 28/170; 66/147

[56] References Cited

U.S. PATENT DOCUMENTS

| | | | |
|---|---|---|---|
| 2,921,359 | 1/1960 | Cotumaccio | 28/170 |
| 3,820,315 | 6/1974 | Franzen et al. | 242/35.5 R X |
| 4,477,035 | 10/1984 | O'Connor | 242/67.1 R |
| 4,498,640 | 2/1985 | Nowak | 242/DIG. 2 X |
| 4,580,737 | 4/1986 | Schmid | 242/35.5 R |

OTHER PUBLICATIONS

Advertising flyer of Alfred Heitzman Machine Works, Inc., Moonachie, N.J.

*Primary Examiner*—David Werner

*Attorney, Agent, or Firm*—Mattern, Ware, Stoltz & Fressola

[57] ABSTRACT

A multiple winding machine for winding lace bands or similar type fabric material onto cores uses a plurality of cup-like guides through which the lace bands pass. The guides are positioned horizontally and vertically with respect to each other so as to be aligned with a corresponding core onto which the lace band is wound. The guides move transversely in a back-and-forth path so that the lace bands wind on the corresponding cores in a uniform, tightly packed manner. Transfer rollers provide uniform tension to the lace bands while imparting uniform tangentional speed to the cores and lace bands as the lace bands are wound on the cores. A mechanism for determining improper removal of draw threads between adjacent lace bands is also disclosed so as to stop the machine if a faulty removal condition exists.

45 Claims, 3 Drawing Sheets

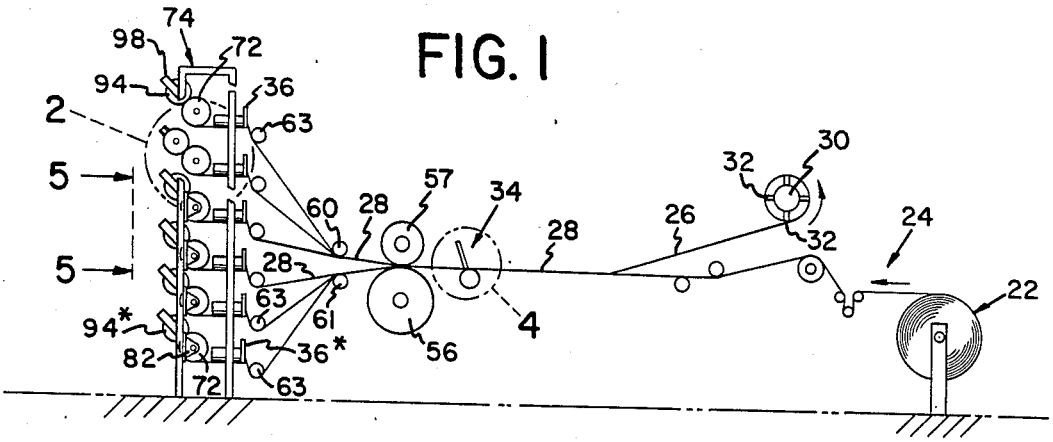
FIG. 1
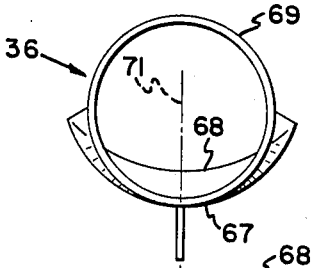
FIG. 3B
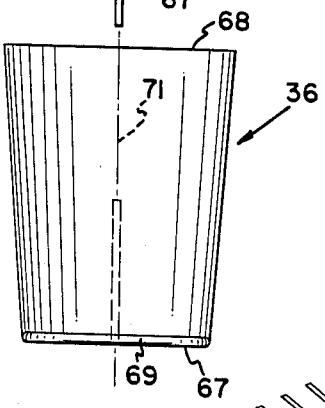
FIG. 3A
FIG. 4
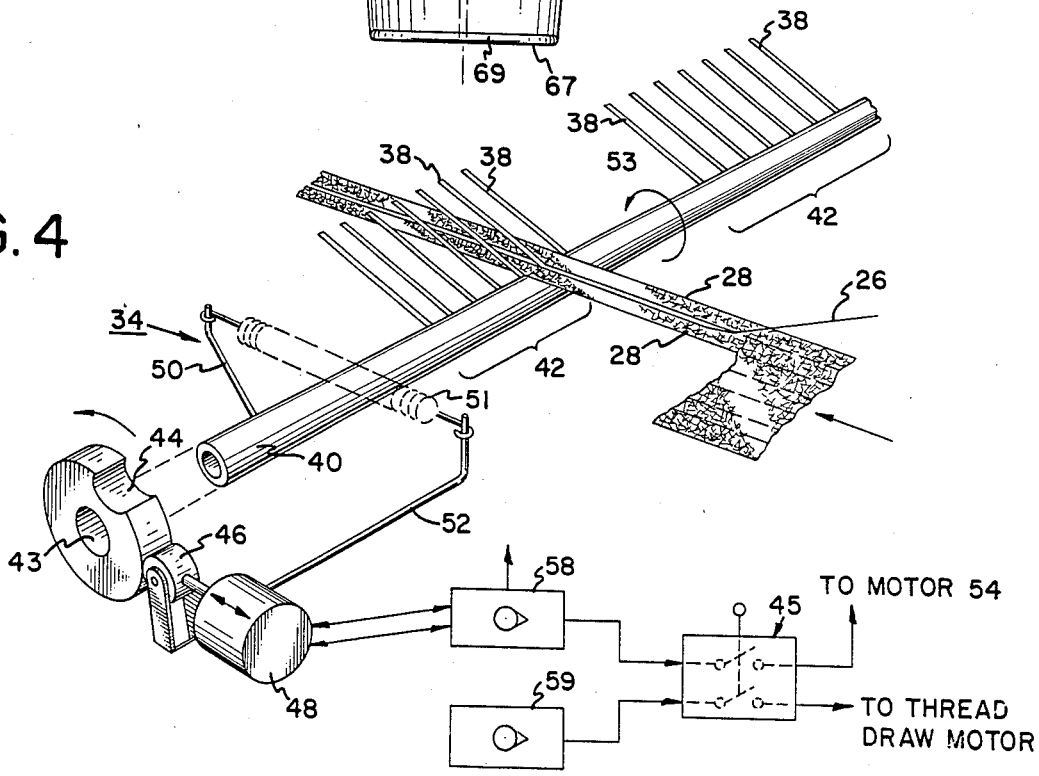

MULTIPLE WINDING MACHINE FOR LACE BANDS AND THE LIKE

TECHNICAL FIELD

The present invention relates to winding machines and particularly to lace band winding machines wherein a plurality of lace bands are first separated from a finished web fabric by withdrawal of draw threads by a thread draw machine and then wound onto cores or spools.

BACKGROUND ART

A number of winding machines exists in the art which are specifically directed to winding threads or thread-like materials onto one or more cores or beams. In the knitting art, beaming machines such as those disclosed in U.S. Pat. No. 4,326,322, Gaiser, assigned to the present assignee, are capable of simultaneously winding multiple yarn ends onto elongated beams which are in turn used on Raschel-type knitting machines. Such machines by their very nature deal with very fine threads or yarn ends and typically wind a plurality of these yarn ends onto a single core or beam.

The present invention is directed to a problem which has persisted in the manufacture of elongated fabric bands which are commonly referred to as lace bands. In the manufacture of such lace bands, the material is produced on a fabric web having a width up to approximately 130 inches (330.2 centimeters). The individual lace bands are held together by draw threads positioned between the adjacent bands. The draw threads are designed for removal by conventional thread draw machines.

The separated lace bands typically have widths between one-half inch (1.26 centimeters) and 5 inches (12.7 centimeters). Although the individual lace bands can be removed from the full width of web, the web is typically divided into four or five web sections, each generally containing between 20 and 28 band strips. The web sections are usually sewn together end to end so as to lengthen the individual lace bands. Each individual band is then typically stored in a bin and hand wound onto a spool. The web length for Raschel-type lace is typically 125 yards (114.3 meters), so that four or five sections sewn together form a spool length of between approximately 400 to 500 yards (365.8 to 457.2 meters).

It has been determined that hand winding individual lace bands onto cores as distinguished from spools (cores with flanges on each end) does not normally yield the careful equal tension to the band which is required if the wound lace is to stay on the core without side support. Consequently, the typical hand winding of lace bands onto a core requires the use of end flanges for lateral support.

One prior art machine which has addressed the problem of lace band separation and winding is manufactured by Alfred Heitzman Machine Works, Inc., of Moonachie, N.J., United States of America. Their lace separating and multiple spooling machine first removes the draw threads so as to separate the lace bands. The separated lace bands are then brought to a spooling region where they are wound onto multiple spools. The lace guides used on this machine are mounted on separate arms which depend from one of a plurality of horizontally oriented rods. Each guide is oval in shape having a width approximately equal to the width of the lace band being wound. This particular machine therefore requires separate guides for different lace band widths and therefore the use of this machine when changing from one lace band width to another requires extensive down time. Furthermore, the lace bands are wound on cores having end flanges, wherein the flanges are used to rotate the cores. The flanges are turned by contacting rollers positioned beneath them with tensioning through slippage between the drive rollers and the flanges.

The present invention provides a multiple winding machine wherein a single type of lace band guide is used for all lace band widths ranging from approximately one-half inch (1.26 centimeters) to five inches (12.7 centimeters) which are commonly produced by Raschel-type knitting machines. Furthermore, very precise equal tensioning of the lace bands as they are wound onto cores is achieved by frictional transfer contact between the lace bands and one of the transfer rollers which turn at a constant angular (and therefore tangentional) speed. The constant tangentional speed provides equal tension to the lace bands since this speed is slightly greater than that of the squeeze rollers which pull the separated lace bands after draw thread separation.

Furthermore, the present invention provides a lace band separator detector which ascertains if any draw thread is not removed by the thread draw machine (typically due to breakage of the draw thread), and if so detected, causing the multiple winding machine to stop.

SUMMARY OF THE INVENTION

A multiple winding machine according to the present invention comprises a series of components which separate, guide, tension and wind separated lace bands which are removed from a Raschel-type fabric web upon removal of draw threads connecting the adjacent lace bands. The present invention further comprises a draw thread detector and comb separator which ensures that the lace bands are separated from each other. If an improperly removed draw thread is detected, signifying that two bands are not separated, the detector activates an electrical switch which causes the immediate stoppage of the multiple winding machine. The lace band comb also aligns the lace bands into groups associated with a vertical column of lace band guides.

The draw thread detector is also activated if the winding machine is winding the lace bands faster than the removal of the draw threads by the thread draw machine. If this condition occurs, the draw thread detector stops the winding machine until the draw threads are no longer in contact with the lace band comb; at which point the winding machine automatically resumes operation. During the time that the winding machine is deactivated, the operator can adjust the operating speed of the thread draw removal machine so as to better match its removal rate with the winding rate of the multiple winding machine.

The lace bands are pulled through the comb separator by a pair of squeeze rollers each having a length extending across the entire width of the separated lace bands. The upper roller is squeezed down by air pressure against the lower roller so as to force the separated lace bands therethrough. The lower roller is rotated about its central axis by a motor controlled by a speed controller activated by the machine's operator. The lace bands pulled through the squeeze rollers are somewhat flattened so as to eliminate any curl in the bands which may have occurred due to separation of the draw threads. The lace bands therefore approach the winding portion of the machine without wrinkles.

After passing through the squeeze rollers the lace bands pass between a pair of stationary bars which maintain vertical positions from which the lace bands are drawn up or down to the region of the multiple winding machine associated with the lace band guides. In the preferred embodiment of the present invention a plurality of lace band guides are arranged in five to six rows which are in turn vertically aligned with each other at a slight offset angle. Horizontally outwardly projecting bars are positioned parallel to the frontal terminating ends of the lace band guides so as to provide a vertical displacement to the approaching lace bands, thereby causing the lace bands to pass beneath these bars. This positioning of the lace bands ensures that the bands enter the lowermost region of the lace band guides thereby properly positioning the bands for the winding operation.

The frontal or forward terminating end of each lace band guide has a generally arcuate shape, the guide extending longitudinally rearwardly in a flaired open configuration which provides for the lace band to be centered in the guide and to be relatively flat as it exits the guide at its rearward terminating end.

From the rearward terminating end of the lace band guide the lace band contacts a portion of a transfer roller which revolves with a constant surface (tangentional) velocity slightly greater than that of the squeeze rollers so as to maintain constant tension on the lace bands while simultaneously imparting the same surface velocity to the lace bands wound upon cores affixed to a support rod.

In actual operation the lace bands are individually passed through the corresponding lace band guides, around a portion of the periphery of the corresponding transfer roller and then attached at one end to the core upon which the lace band is to be wound. When the multiple winding machine is in operation the lace band guides move traversely in a back and forth direction so as to cause each lace band to wind itself upon the core in a similar back and forth movement; resulting in the wound lace band to have a uniform constant tension sufficient to allow up to approximatley 500 yards (472.2 meters) of lace band material to be wound onto a single core without the need for end flanges.

In addition, the present can accept lace bands throughout a wide range of widths typically from one-half inch (1.26 cm) to 5 inches (12.7 cm) without the need for changing the lace band guide, the amount of traverse movement of the lace band guide, or the core length. The use of a single core length (typically 12 inches, 30.5 centimeters) greatly reduces the amount of stock otherwise necessary to wind lace bands of various widths. Furthermore, by winding the lace bands with a uniform constant tension, the need for end flanges is eliminated; thereby greatly reducing the material cost associated with conventional lace band winding using cores and end flanges.

Similarly, since different lace band widths can be wound without the need for resetting any parts on the winding machine, the time necessary to change from winding one lace band width to another is greatly reduced as compared to prior art devices.

If desired, the traverse mechanism can be disabled through use of a clutch assembly so that wide lace bands can be wound onto core in a "stack" or aligned orientation. Such winding of wide lace bands is desired by some users of such lace bands.

Thus, a simple and elegant technique for winding separated lace bands from a section of fabric web is achieved by the present invention.

OBJECTS OF THE INVENTION

It is therefore a principal object of the present invention to provide a multiple winding machine for lace bands which incorporates lace band guides through which individual lace bands pass, wherein the lace band guides can accommodate different lace band widths during different winding operations.

Another object of the present invention is to provide a multiple winding machine of the above description wherein the separated lace bands after passing through lace band guides are wound onto individual cores with a uniform tension applied to the lace bands by contact of the wound lace bands on the core with a transfer roller having a constant surface velocity.

A still further object of the present invention is to provide a multiple winding machine of the above description incorporating a traverse mechanism for moving the lace band guides in a back-and-forth path so that the lace bands are wound on the cores in a similar fashion.

Another object of the present invention is to provide a multiple winding machine of the above description wherein each lace band guide has an arcuate frontal (forward) terminating end into which a lace band enters, with the lace band guide having a shallower arcuate rearward terminating end so that the lace band as it leaves the lace band guide has a relatively flat orientation approximately centered with the center line of the lace band guide, thereby ensuring that the lace band wound onto the core will have a flat, uniform, non-wrinkled pattern.

A still further object of the present invention is to provide a multiple winding machine of the above description further incorporating a lace band comb through which the lace bands pass after separation by a thread draw machine, the comb spatially positioning the lace bands with respect to each other so that each lace band will be approximately aligned in the vertical plane with its corresponding lace band guide through which it is to pass.

Another object of the present invention is to provide a multiple winding machine of the above description wherein the lace band comb further incorporates a longitudinal rod into which the comb fingers are placed, the rod associated with a cam element such that if two or more lace bands are not properly separated as they pass through the comb, the longitudinal rod will turn due to movement of the comb fingers; thereby causing the cam to deactivate a switch to stop further operation of the multiple winding machine.

A still further object of the present invention is to provide a multiple winding machine of the above description incorporating a pair of adjacent squeeze rollers through which the lace bands pass after passing through the lace band comb, the rollers pulling the separated lace bands through the comb and flattening any wrinkled lace bands.

Another object of the present invention is to provide a multiple winding machine of the above description incorporating a clutch assembly to disable the traverse mechanism so as to wind wide lace bands in a "stack" configuration.

Other objects of the present invention will in part be obvious and will in part appear hereinafter.

BRIEF DESCRIPTION OF THE DRAWINGS

For a fuller understanding of the nature and objects of the present invention, reference should be made to the detailed description taken in conjunction with the accompanying drawings, in which:

FIG. 1 is a diagrammatic side elevational view of the multiple winding machine according to the present invention showing in phantom the accumulation of separated draw threads upon a draw thread take-up roller and further showing the various elements of the present invention through which and in conjunction with the separated lace bands pass in order to be wound onto cores.

FIG. 3A is an enlarged top plan view of the lace band guide taken along line 3A—3A as shown in FIG. 2.

FIG. 3B is an enlarged front elevational view of the lace band guide taken along line 3B—3B in FIG. 2.

FIG. 4 is an enlarged perspective view of the lace band comb and draw thread detector shown in FIG. 1 as a phantom circle identified by the numeral 4.

BEST MODE FOR CARRYING OUT THE INVENTION

Figure 2:
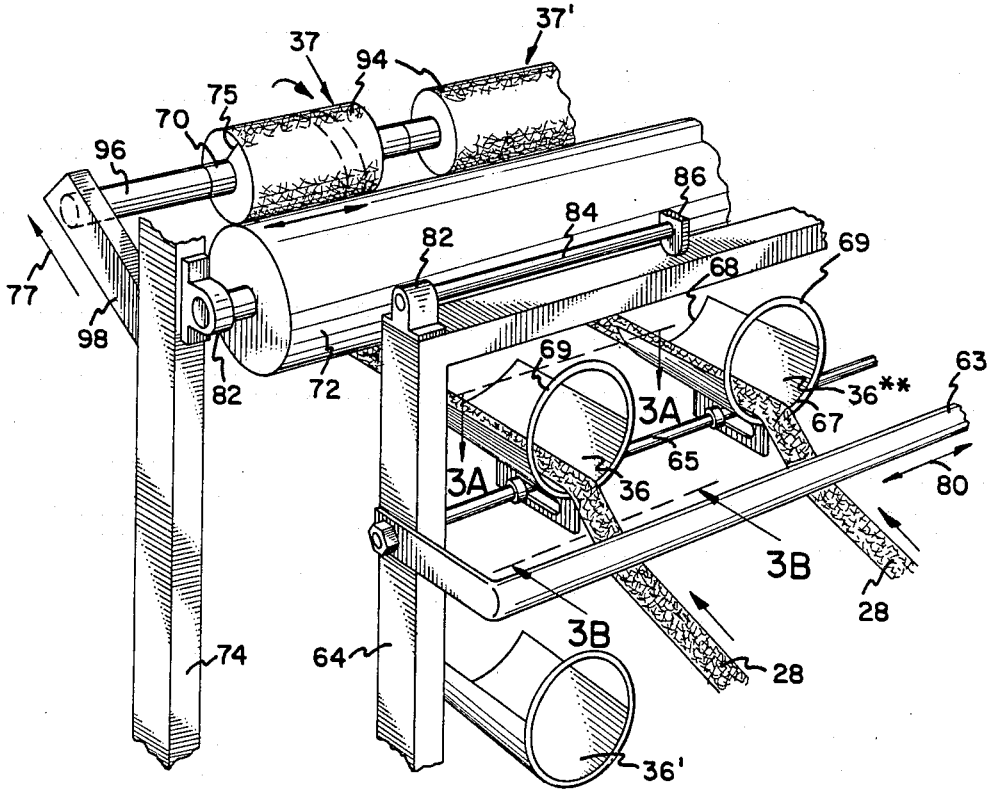
FIG. 2 is an enlarged perspective view of the portion of the winding machine shown in the phantom circled portion of FIG. 1 identified by the numeral 2, the figure showing how each separated lace band passes underneath a lace band vertical positioning bar so as to cause the lace band to enter a lace band guide at the lowermost portion thereof and for it to exit from the lace band guide so as to pass over a portion of the transfer roller surface for winding onto a core mounted on a take-up bar which is free to both rotate and to move away from the transfer roller.

As seen in FIGS. 1 and 2, a multiple winding machine 20 according to the present invention is used to wind lace bands 28 onto cores 70 after the lace bands are separated by a conventional thread draw removal apparatus 24. Such an apparatus removes draw threads 26 sewn between adjacent lace bands 28 as best seen in FIG. 4. Prior to such removal, the lace bands form a fabric web section 22 wound onto a shaft 23.

The fabric web section 22 typically comprises twenty to twenty-eight lace bands sewn together during this fabrication by adjacent draw threads and has a usual length of between 400 and 500 yards (365.8 to 457.2 meters). This lace band web section in turn is typically formed from a single, wider web having a width up to approximately 130 inches (330.2 cm) which is broken down into four to five sections each having a length of approximately 100 yards (91.5 meters) sewn together so as to form an overall length of the stated 400 to 500 yards (365.8 to 457.2 meters). The fabric web section 22 consequently has a width of approximately 26 to 32.5 inches (66.0 to 82.6 cm). The individual lace bands typically have a width of between one-half inch (1.26 cm) and five inches (12.7 cm); although the width of the lace bands associated with any fabric web section will be the same for the entire web.

The removed draw threads 26 which hold the adjacent lace bands together in the fabric web section 22 are taken up onto a thread draw roller 30 having radially extending channels 32 positioned across its entire length so as to facilitate capture of the draw threads. Such devices are well known in the art.

As best seen in FIGS. 1 and 4, the separated lace bands 28 pass through a lace band comb, draw thread detector 34, which helps to spatially separate the lace bands so as to be properly aligned with the corresponding lace band guide 36 to which it is associated. The comb fingers 38 are placed into a support rod 40. The comb fingers that cause the separated lace bands to move laterally with respect to the web section are preferably set at a slanted angle with respect to the longitudinal axis of the support rod so as to help ensure that the separated lace bands cannot jump out of the adjacent fingers supporting the individual lace bands.

Figure 5:
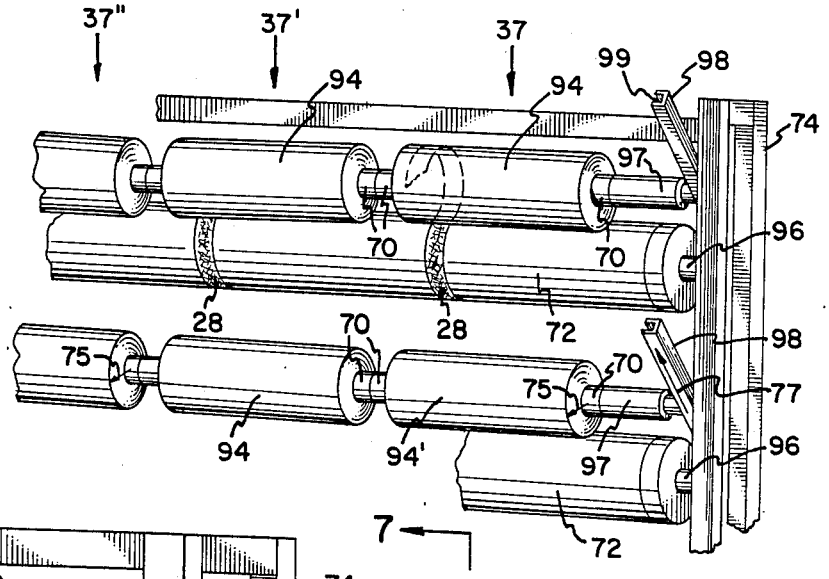
FIG. 5 is a partial perspective view of the take-up roller cores and lace bands wound onto the cores taken in the general direction of line 5—5 as shown in FIG. 1.

As seen in FIG. 4, fingers 38 are positioned in a plurality of groups 42, each group associated with one of four vertical columns of lace band guides and cores such as lace band guides 36, 36' through 36* and cores 94, 94' through 94* shown in FIGS. 1, 2 and 5 (in FIG. 2, only lace band guides 36 and 36' of the first vertical row are shown) corresponding to vertical column 37. As seen in FIGS. 2 and 4, the guides and cores in each vertical column are slighly offset in the horizontal direction from each other in order to be more nearly vertically aligned with the lace bands associated with each group. In the preferred embodiment of the present invention, each vertical column therefore comprises six lace band guides and cores, with there being up to four lace band guides and cores in each horizontal rows such as shown in FIG. 2 wherein lace band guides 36 and 36 are shown. Of course the number of lace band guides and corresponding cores, including the number in any vertical column or horizontal row, can be changed to accommodate the total number of lace bands that are removed from the fabric web section 22**. Typically between 20 and 28 lace bands are formed by a web section and consequently the six vertical columns, each having up to four lace band guides in the corresponding horizontal row, is sufficient for up to 24 separate lace bands.

Referring again to FIG. 4, support rod 40 is secured to notched wheel 43 by placement within circular hole 43. The notched portion 44 of wheel 42 engages with a cam arm 46 which controls operation of switch 48. An arm 50 attached to support rod 40 has a spring 51 attached to it at one end, the spring also attached to a second arm 52 connected to cam arm 46 so as to bias the arm toward wheel 42. Thus, if a pair of lace bands are not separated, the draw thread 26 between these adjacent bands will impinge upon one of the comb fingers 38 which will then cause the support rod 40 to rotate in a direction shown by arrow 53, which in turn causes wheel 42 to rotate, moving cam arm 46 toward switch 48, thereby disengaging the electrical motor 54 (see FIG. 7) which drives the rollers and traverse mechanism associated with the multiple winding machine. Thus in any situation where an improperly removed draw thread is detected, the multiple winding machine is automatically stopped so as to prevent improper winding of the lace bands onto the multiple winding machine cores.

As seen in FIG. 4, the thread draw machine 24 is not connected to switch 48 and thus will continue to run until master switch 45 is disengaged (the operator so stops the thread draw machine if an improperly removed draw thread trips the detector 34). The reason for not automatically stopping the thread draw machine is that the comb and draw thread detector 34 have another purpose besides detection of improperly removed draw threads; that is, the disengagement of switch 48 when the multiple winding machine motor 54 is operating at a speed somewhat faster than that of the thread draw machine, at which point all the draw threads cause detector support rod 40 to rotate. When this condition occurs, the operator needs to either decrease the speed of motor 54 by means of motor control 58, or to increase the speed of the thread draw machine by increasing the speed of its motor (not shown) by means of a second motor control 59. Upon such adjustment of motor control 58 or 59, the draw threads (since the thread draw machine is still operating) will move backwards, away from comb fingers 38, which thereby allows detector 34 to move back to its engaged position due to the bias exerted by spring 51. The engaged position then energizes motor 54. Thus, the operator can easily correct for any mismatch in speed between the thread draw machine and the multiple winding machine without the need for manually stopping the winding machine. This feature helps improve the overall operating efficiency of the present invention.

Figure 7:
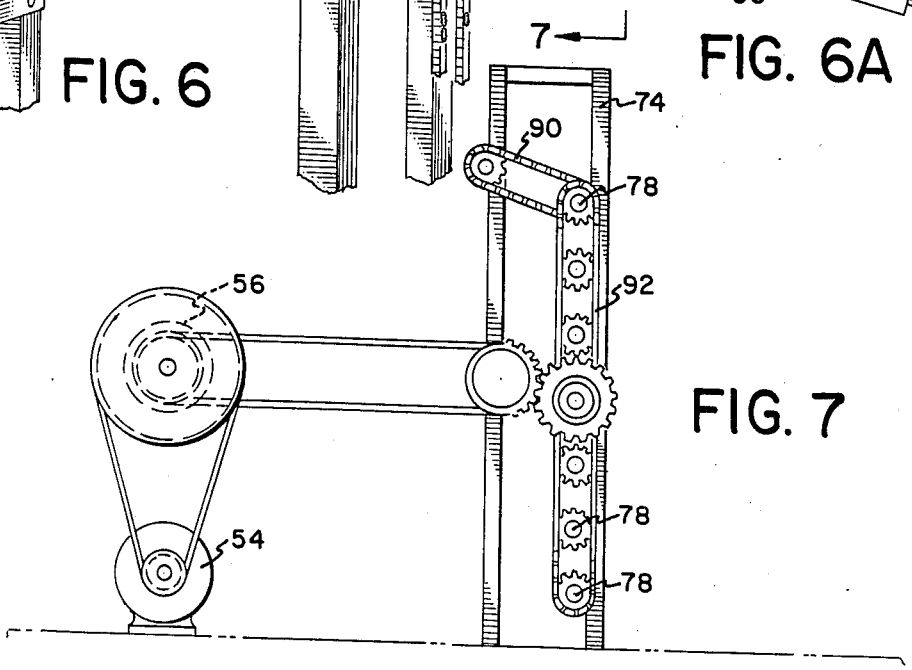
FIG. 7 is a right elevational view taken along line 7—7 in FIG. 6, illustrating the mechanism by which the transfer rollers and the crosswind traverse mechanism are powered.

Again referring to FIG. 1, the separated lace bands after passing through the lace band comb and thread draw detector 34 pass between a pair of squeeze rollers 56 and 57 which draw the separated lace bands through the lace band comb and draw thread detector. Roller 56 is typically driven by motor 54 as seen in FIG. 7, wherein the speed of motor 54 is controlled by motor control 58 shown in FIG. 4.

Roller 57 preferably is forced downward into contact with roller 56 by an air-operated mechanism (not shown) so as to maintain squeeze roller 57 against roller 56 at a constant pressure.

The purpose of squeeze rollers 56 and 57 is to pull the separated lace bands through the lace band comb and draw thread detector as well as to ensure that the lace bands passing through the squeeze rollers are relatively flat and unwrinkled; thereby facilitating their winding upon the cores of the multiple winding machine.

As seen in FIG. 1, the separated lace bands 28 pass against stationary bars 60 and 61 which vertically position the lace bands for travel to their respective lace band guides. As seen in FIGS. 1 and 2, the lace bands then contact one of a series of positioning bars 63, each bar associated with one of the horizontal rows of lace band guides. The positioning bars are spaced slightly below the lowermost position of the lace band guides to which they are associated so that the lace bands are forced to enter the guides at the lowermost portion of the guides. The positioning bars are attached to a rectangular frame 64 onto which the lace band guides 36 are attached by means of horizontal rods 65.

As seen in FIGS. 2, 3A and 3B, each lace band guide has a forward or frontal terminating end 67 and a rearward terminating end 68, the forward terminating end being more arcuate in shape than the rearward terminating end. In the preferred embodiment, the guides have a forward terminating end with a 4-inch (10.2 cm) radius of curvature and a rearward terminating end with an 8-inch (20.3 cm) radius of curvature. A typical preferred length along bilateral symmetry line 71 (shown in phantom) is 8 inches (20.3 cm). These dimensions may be changed somewhat so long as the lace bands can exit the guide in a relatively flat orientation. A wire guard 69 may be included at the forward terminating end to prevent possible displacement of the lace band. In practice, however, it has not been found necessary for proper operation.

The overall shape and cup-like nature of the lace band guides allow for various lace band widths to be accommodated without the need for changing the guides while ensuring that the lace bands exit the lace band guides more or less centered with respect to the bilateral symmetry of the lace band guides (see dotted line 71 showing the bilateral symmetry). This centering of the lace bands ensures proper positioning of the bands for winding onto the cores.

The actual winding of the separated lace bands onto associated cores 70 is best seen with reference to FIGS. 1, 2 and 5. As there seen, the lace bands exiting from the lace band guides pass over a portion of the surface of transfer roller 72 associated with the lace band guides in each horizontal row. Each transfer roller is attached to frame 74 by means of pillow blocks 82, with each transfer roller turned about its axis by means of a gear and chain mechanism as best seen in FIG. 7. Thus each gear 78 (FIG. 7) is associated with a corresponding transfer roller as best seen in FIG. 1. The surface of the transfer roller is preferably made from a relatively high-friction material such as a rubberized material which imparts good frictional contact to the lace band passing over the periphery of the transfer roller as best seen in FIG. 5.

In actual operation, each lace band 28 is attached to its corresponding core 70 by means of tape or the like (not shown) with the core then making frictional contact with the transfer roller 72. The lace band can alternatively be wrapped about the core for a few turns without the need for tape. As the multiple winding machine is operated, the core is turned by frictional contact with its corresponding transfer roller 72 which thereby causes the associated lace band to wind about the core.

Figure 6:
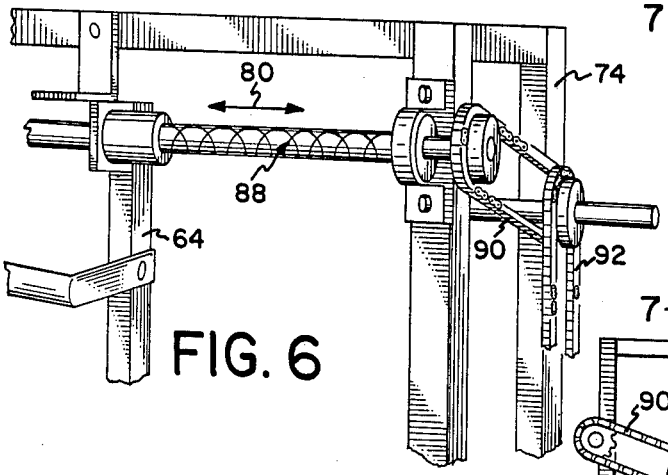
FIG. 6 is a partial perspective view of the back-and-forth crosswind traverse mechanism or ball reverser associated with the lace band guide frame which is positioned at the right-handmost position of the multiple winding machine from the perspective shown in FIG. 2, the crosswind mechanism causing the lace band guides to move in their back-and-forth crosswind paths.

As seen in FIGS. 2 and 6, the frame 64 upon which the lace band guides 36 and positioning rods 63 are attached is in turn moved in a back-and-forth path as shown by arrow 80 with frame 64 supported to frame 74 so as to allow this transverse movement by means of pillow blocks 82 passing through hanger rods 84 which are attached to the frame 74 by means of hangers 86 (only one hanger and pillow block is shown in FIG. 2 but corresponding hangers and pillow block are positioned at the lower termination of frame 64).

Transverse back-and-forth movement of frame 64 and thus to the lace band guides 36 is achieved by means of a ball reverser (or crosswind) mechanism 88 seen in FIG. 6. This mechanism is commercially available and is driven by chain 90 which in turn is driven by chain 92 associated with the transfer rollers (FIG. 7). Thus the back-and-forth movement of the frame and the associated lace band guides is coordinated with the turning of the transfer rollers; thereby ensuring that the lace bands are wound onto their cores 70 in a uniform back-and-forth pattern.

Furthermore, as seen in FIG. 7, the transfer rollers 72 are driven by gears 78 at a tangentional speed which is approximately 3 percent faster than that of squeeze roller 56. This speed difference ensures that the individual lace bands are pulled and wound onto the cores in a slightly taut fashion which thereby ensures that the wound lace band 94 has a uniform tension which eliminates the need for end flanges on the core 70. Such end flanges are required by the prior art. The elimination of end flanges greatly reduces the amount of different material otherwise needed to wind lace bands of varying widths. Furthermore, it has been experimentally found that the ball reverser mechanism 88 need not be adjusted for varying width lace bands and a core having a length of approximately 12 inches (30.5 cm) is sufficient for winding lace bands ranging from one-half inch (1.26 cm) to five inches (12.7 cm) for up to 500 yards in length (457.2 meters). Typically a one inch (2.54 cm) space is left unwound on each end of the core so that the wound lace band 94 has a wound pattern of 10 inches (25.4 cm).

Eliminating the need to change the core lengths, as well as eliminating the need for end flanges associated with the cores, greatly reduces material cost for winding separated lace bands. The ability of the lace band guides to accommodate varying widths of lace bands without the need for changing the guide, as is required in the Heitzman prior art winding machine, greatly reduces the set-up time required for changing from one lace band width to another.

As seen in FIGS. 2 and 5, in order to accommodate the growing outward radius 75 of wound lace upon the cores, the cores are allowed to move away from their corresponding transfer roller 72 by mounting the cores over support rods 97 which in turn are allowed to rotate within channel members 98. The channel members however do not prohibit the support rods from moving away from their corresponding transfer roller 72 along longitudinal paths shown by arrow 77 and thus as the lace bands wind themselves about the cores, the support rods move away from the transfer roller while maintaining the frictional contacts between the lace bands and the transfer rollers.

Spacer members 97 are positioned at each end of the support rods so as to ensure that the core positions are maintained.

Figure 6A:
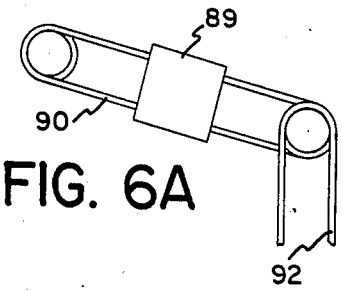
FIG. 6A is a diagrammatic view of the ball reverser portion of the present invention showing an optional clutch assembly which can be disengaged so as to prevent back-and-forth movement of the ball reverser and thereby maintain the ball reverser in a fixed position.

As seen in FIG. 6A, an alternative embodiment of the present invention allows for "stack" winding of wide lace bands through use of a clutch mechanism 89. "Stack" winding refers to non-traverse movement of the lace band guides which results in the lace bands being wound onto the cores in an outwardly growing stack. Some companies which use wide lace band material prefer the lace bands wound in this fashion. The clutch mechanism simply allows for disengagement of ball reverser 88 from drive chain 92, thereby maintaining the ball reverser in a set orientation. This set orientation keeps the lace band guides from moving back-and-forth so that the lace bands wind onto the cores in a straight-line fashion.

Upon completion of the winding operation, the support rods are simply pulled up out of the channels 98 through open end 99. The spacer members are then removed along with the cores from support rods 96.

Thus what has been described in a multiple winding machine which is capable of winding a plurality of lace bands which are removed from a fabric web section by a thread draw machine and which is able to accommodate lace band widths of varying sizes. The multiple winding machine is easily set-up for any given lace band width and by maintaining a constant tension on the lace bands as they are wound onto their associated cores, elimination of core end flanges is achieved. Furthermore, a single core length can be used for a plurality of lace band widths, thereby further reducing the material costs associated with the winding of lace bands.

The lace band comb and draw thread detector provides the means by which a faulty withdrawal of draw threads is automatically detected, thereby preventing non-separated lace bands from being wound onto the multiple winding machine. The detector also stops the winding machine when the thread draw machine is not removing the draw threads rapidly enough so as to keep pace with the winding machine.

The invention thereby achieves a highly-desirable result in an efficient manner.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limited sense.

It is also to be understood that the following claims are intended to cover all of the generic and specific features of the invention herein described, and all statements of the scope of the invention which, as a matter of language, might be said to fall therebetween.

Having described the invention, what is claimed is:

1. A multiple winding machine for winding separated lace bands produced from a fabric web comprising:

(A) a plurality of lace band guides, each lace band guide associated with one lace band, each lace band guide having an arcuately shaped surface over which a lace band passes, the plurality of lace band guides have a forward arcuate terminating end for receipt of the lace band and a rearward terminating end having a shallower arcuate shape for allowing the lace band to exit from the lace band guide in a relatively flat orientation;

(B) means attached to the lace band guides for causing the lace band guides to move in a back-and-forth direction so as to impart a similar back-and-forth movement to the lace bands passing through each lace band guide;

(C) at least one transfer roller, each transfer roller positioned in proximity to one or more lace band guides for pulling the lace bands through the lace band guides;

(D) a corresponding plurality of cores, each core contacting a transfer roller so as to be turned when the transfer roller turns and so that a lace band attached to each core is similarly turned by the transfer roller;

(E) means for maintaining the plurality of cores in frictional rolling engagement with the transfer roller; and (F) means for powering each transfer roller and means for causing back-and-forth movement of the lace band guides; whereby as each transfer roller turns, the lace band guides move in a back-and-forth path so as to cause the lace bands to wind about the cores in a similar back-and-forth path with each wound lace band being turned by a transfer roller.

2. A multiple winding machine as defined in claim 1 wherein the means for maintaining each core in frictional rolling engagement with a transfer roller comprises at least one pair of channel members, each pair of channel members extending upwardly away from one transfer roller so as to define a longitudinal path extending away from the transfer roller, said multiple winding machine further comprising at least one support rod, each support rod associated with one transfer roller and positioned for axial rotation and movement along the longitudinal path of a pair of channel members; wherein the cores are removably mounted to the support rod for frictional engagement with a transfer roller.

3. A multiple winding machine as defined in claim 2 wherein the means attached to the lace band guides for causing the guides to move in a back-and-forth direction comprises a frame and positioning rods, the positioning rods connected to the frame and further connected to the lace band guides for maintaining the lace band guides in a fixed orientation with respect to the frame.

4. A multiple winding machine as defined in claim 3 wherein the means for causing back-and-forth movement to the lace band guides includes a ball reverser connected to the frame and powered by said powering means, said ball reverser moving the frame in said back-and-forth path.

5. A multiple winding machine as defined in claim 4 further comprising means for positioning the separated lace bands with respect to each other so that each lace band is substantially aligned in the vertical plane associated with its corresponding core.

6. A multiple winding machine as defined in claim 5 wherein the means for positioning the lace bands comprises a lace band comb positioned upstream with respect to the lace band guides.

7. A multiple winding machine as defined in claim 6 wherein the lace band comb includes a bar and a plurality of fingers extending upwardly from the bar through which the separated lace bands pass.

8. A multiple winding machine as defined in claim 7 further comprising a draw thread detector for sensing the presence of unseparated lace bands and upon such sensing causing the multiple winding machine to stop said powering means.

9. A multiple winding machine as defined in claim 8 further comprising means for pulling the separated lace bands away from the fabric web.

10. A multiple winding machine as defined in claim 9 wherein the means for pulling the separated lace bands comprises a pair of squeeze rollers positioned between the lace band comb and lace band guides, said squeeze rollers also for ensuring that the separated lace bands are relatively flat and unwrinkled as they approach the lace band guides.

11. A multiple winding machine as defined in claim 11 wherein the lace band guides are aligned in a plurality of horizontally positioned rows and further wherein horizontally positioned bars are spaced below the forward arcuate terminating end of the lace band guides associated with each horizontal row so that the lace bands contact a portion of the associated bar, thereby ensuring that the lace bands enter the lace band guides at the lowermost position of the forward end of the lace band guides.

12. A multiple winding machine as defined in claim 11 further comprising a pair of stationary bars positioned between the squeeze rollers and the horizontally positioned bars so that the lace bands exiting the squeeze rollers pass between the stationary bars.

13. A multiple winding machine as defined in claim 12 further comprising spacers mounted to the ends of the support rods so as to maintain the position of the cores on the support rods.

14. A multiple winding machine as defined in claim 1 wherein the means for maintaining each core in frictional rolling engagement with a transfer roller comprises at least one pair of channel members, each pair of channel members extending upwardly away from one transfer roller so as to define a longitudinal path extending away from the transfer roller, said multiple winding machine further comprising at least one support rod, each support rod associated with one transfer roller and positioned for axial rotation and movement along the longitudinal path of a pair of channel members; wherein the cores are removably mounted to the support rod for frictional engagement with a transfer roller.

15. A multiple winding machine as defined in claim 1 wherein the means attached to the lace band guides for causing the guides to move in a back-and-forth direction comprises a frame and positioning rods, the positioning rods connected to the frame and further connected to the lace band guides for maintaining the lace band guides in a fixed orientation with respect to the frame.

16. A multiple winding machine as defined in claim 15 wherein the means for causing back-and-forth movement to the lace band guides includes a ball reverser connected to the frame and powered by said powering means, said ball reverser moving the frame in said back-and-forth path.

17. A multiple winding machine as defined in claim 16 further comprising means for positioning the separated lace bands with respect to each other so that each lace band is substantially aligned in the vertical plane associated with its corresponding core.

18. A multiple winding machine as defined in claim 1 further comprising means for positioning the separated lace bands with respect to each other so that each lace band is substantially aligned in the vertical plane associated with its corresponding core.

19. A multiple winding machine as defined in claim 18 wherein the means for positioning the lace bands comprises a lace band comb positioned upstream with respect to the lace band guides.

20. A multiple winding machine as defined in claim 19 further comprising a draw thread detector for sensing the presence of unseparated lace bands and upon such sensing causing the multiple winding machine to stop said powering means.

21. A multiple winding machine as defined in claim 20 further comprising means for pulling the separated lace bands away from the fabric web.

22. A multiple winding machine as defined in claim 21 wherein the means for pulling the separated lace bands comprises a pair of squeeze rollers positioned between the lace band comb and lace band guides, said squeeze rollers also for ensuring that the separated lace bands are relatively flat and unwrinkled as they approach the lace band guides.

23. A multiple winding machine for winding separated lace bands produced from a fabric web comprising:

(A) means for pulling the separated lace bands away from the fabric web;

(B) means for positioning the separated lace bands with respect to each other;

(C) a plurality of lace band guides, each lace band guide associated with one lace band, each lace band guide having a generally cup-like shape having a forward arcuate terminating end for receipt of the lace band and a rearward terminating end having a shallower arcuate shape for allowing the lace band to exit from the lace band guide;

(D) means attached to the lace band guides for causing the lace band guides to move in a back-and-forth direction so as to impart a similar back-and-forth movement to the lace bands passing through each lace band guide;

(E) at least one transfer roller, each transfer roller positioned in proximity to one or more lace band guides for pulling the lace bands through the lace band guides;

(F) at least one pair of channel members, each pair of channel members extending upwardly away from one transfer roller, each channel member defining a longitudinal path extending away from the transfer roller;

(G) at least one support rod, each support rod associated with one transfer roller and positioned for axial rotation and movement along the longitudinal path of the channel members;

(H) a corresponding plurality of cores removably mounted to the support rod, each core contacting a transfer roller so as to be turned when the transfer roller turns and so that a lace band attached to each core is similarly turned by the transfer roller; and (I) means for powering the separated lace band pulling means, each transfer roller, and the means for causing back-and-forth movement of the lace band guides;

whereby as the transfer roller turns, the lace band guides move in a back-and-forth path so as to cause the lace bands to wind about the cores in similar back-and-forth paths with each wound lace band being turned by a transfer roller.

24. A multiple winding machine as defined in claim 23 wherein the means attached to the lace band guides for causing the guides to move in a back-and-forth direction comprises a frame and positioning rods, the positioning rods connected to the frame and further connected to the lace band guides for maintaining the lace band guides in a fixed orientation with respect to the frame.

25. A multiple winding machine as defined in claim 24 wherein the means for causing back-and-forth movement to the lace band guides includes a ball reverser connected to the frame and powered by said powering means, said ball reverser moving the frame in said back-and-forth path.

26. A multiple winding machine as defined in claim 25 wherein the means for positioning the lace bands comprises a lace band comb positioned upstream with respect to the lace band guides for positioning each lace band in the vertical plane substantially associated with its corresponding core.

27. A multiple winding machine as defined in claim 26 wherein the lace band comb includes a bar and a plurality of fingers extending upwardly from the bar through which the separated lace bands pass.

28. A multiple winding machine as defined in claim 27 further comprising a draw thread detector for sensing the presence of unseparated lace bands and upon such sensing causing the multiple winding machine to stop said powering means.

29. A multiple winding machine as defined in claim 28 further comprising means for spring biasing the lace band comb bar in an upright orientation and wherein the draw thread detector includes a cam connected to the lace band comb bar, a cam arm contacting the cam, and a switch controlling the powering means, said switch operated by the cam arm so that rotation of the lace band comb causes the cam arm to disengage the switch thereby disengaging the powering means.

30. A multiple winding machine as defined in claim 24 wherein the means for positioning the lace bands comprises a lace band comb positioned upstream with respect to the lace band guides for positioning each lace band in the vertical plane substantially associated with its corresponding core.

31. A multiple winding machine as defined in claim 30 wherein the means for pulling the separated lace bands comprises a pair of squeeze rollers positioned between the lace band comb and the lace band guides, said squeeze rollers also for ensuring that the separated lace bands are relatively flat and unwrinkled as they approach the lace band guides.

32. A multiple winding machine as defined in claim 31 wherein the lace band guides are aligned in a plurality of horizontally positioned rows and further wherein hroizontally positioned bars are spaced below the forward arcuate terminating end of the lace band guides associated with each horizontal row so that the lace bands contact a portion of the associated bar, thereby ensuring that the lace bands enter the lace band guides at the lowermost position of the forward end of the lace band guides.

33. A multiple winding machine as defined in claim 32 further comprising a pair of stationary bars positioned between the squeeze rollers and the horizontally positioned bars so that the lace bands exiting the squeeze rollers pass between the stationary bars.

34. A multiple winding machine as defined in claim 33 wherein the transfer rollers have their surface covered with a frictionally-gripping material.

35. A multiple winding machine as defined in claim 34 wherein the frictionally-gripping material is a rubberized material.

36. A multiple winding machine as defined in claim 32 further comprising switching means for simultaneously controlling a thread draw machine with the multiple winding machine.

37. A multiple winding machine as defined in claim 23 wherein the means for positioning the lace bands comprises a lace band comb positioned upstream with respect to the lace band guides for positioning each lace band in the vertical plane substantially associated with its corresponding core.

38. A multiple winding machine as defined in claim 37 wherein the means for pulling the separated lace bands comprises a pair of squeeze rollers positioned between the lace band comb and the lace band guides, said squeeze rollers also for ensuring that the separated lace bands are relatively flat and unwrinkled as they approach the lace band guides.

39. A multiple winding machine as defined in claim 38 wherein the lace band guides are aligned in a plurality of horizontally positioned rows and further wherein horizontally positioned bars are spaced below the forward arcuate terminating end of the lace band guides associated with each horizontal row so that the lace bands contact a portion of the associated bar, thereby ensuring that the lace bands enter the lace band guides at the lowermost position of the forward end of the lace band guides.

40. A multiple winding machine as defined in claim 39 wherein the means attached to the lace band guides for causing the guides to move in a back-and-forth direction comprises a frame and positioning rods, the positioning rods connected to the frame and further connected to the lace band guides for maintaining the lace band guides in a fixed orientation with respect to the frame.

41. A multiple winding machine as defined in claim 40 wherein the means for causing back-and-forth movement to the lace band guides includes a ball reverser connected to the frame and powered by said powering means, said ball reverser moving the frame in said back-and-forth path.

42. A multiple winding machine as defined in claim 37 wherein the means attached to the lace band guides for causing the guides to move in a back-and-forth direction comprises a frame and positioning rods, the positioning rods connected to the frame and further connected to the lace band guides for maintaining the lace band guides in a fixed orientation with respect to the frame.

43. A multiple winding machine as defined in claim 42 wherein the means for causing back-and-forth movement to the lace band guides includes a ball reverser connected to the frame and powered by said powering means, said ball reverser moving the frame in said back-and-forth path.

44. A multiple winding machine as defined in claim 23 wherein the means for causing back-and-forth movement of the lace band guides further comprises manually operable means for disengaging said back-and-forth movement so as to wind lace bands in a "stacked" orientation on the cores.

45. A multiple winding machine for winding separated lace bands produced from a fabric web comprising:

(A) a plurality of lace band guides, each lace band guide associated with one lace band, each lace band guide having an arcuately shaped surface over which a lace band passes;

(B) means attached to the lace band guides for causing the lace band guides to move in a back-and-forth direction so as to impart a similar back-and-forth movement to the lace bands passing through each lace band guide;

(C) at least one transfer roller, each transfer roller positioned in proximity to one or more lace band guides for pulling the lace bands through the lace band guides;

(D) a corresponding plurality of cores, each core contacting a transfer roller so as to be turned when the transfer roller turns and so that a lace band attached to each core is similarly turned by the transfer roller;

(E) means for maintaining the plurality of cores in frictional rolling engagement with the transfer roller, the means for maintaining each core in frictional rolling engagement with the transfer roller comprises at least one pair of channel members, each pair of channel members extending upwardly away from one transfer roller so as to define a longitudinal path extending away from the transfer roller;

(F) at least one support rod, each support rod associated with one transfer roller and positioned for axial rotation and movement along the longitudinal path of a pair of channel members; wherein the cores are removably mounted to the support rod for frictional engagement with a transfer roller; and (G) means for powering each transfer roller and means for causing back-and-forth movement of the lace band guides;

whereby as each transfer roller turns, the lace band guides move in a back-and-forth path so as to cause the lace bands to wind about the cores in a similar back-and-forth path with each wound lace band being turned by a transfer roller.

* * * * *